United States Patent [19]

Mouissie

[11] Patent Number: 4,838,809

[45] Date of Patent: Jun. 13, 1989

[54] POWER CONNECTOR

[75] Inventor: Bob Mouissie, EK Berlicum, Netherlands

[73] Assignee: E. I. DuPont de Nemours and Co., Wilmington, Del.

[21] Appl. No.: 146,406

[22] Filed: Jan. 21, 1988

[30] Foreign Application Priority Data

Jan. 28, 1987 [NL] Netherlands ..... 8700210

[51] Int. Cl.[4] ..... H01R 13/635; H01R 13/639

[52] U.S. Cl. ..... 439/155; 439/358; 439/383; 439/467

[58] Field of Search ..... 439/465–468, 439/62, 629, 374–377, 246, 252, 383, 385, 350–358, 152, 153, 155, 156, 159

[56] References Cited

U.S. PATENT DOCUMENTS

| | | | |
|---|---|---|---|
| 2,372,987 | 4/1945 | Shaver | 439/366 |
| 3,970,802 | 7/1976 | Nijman | 379/325 |
| 4,080,038 | 3/1978 | Latta et al. | 439/467 |
| 4,095,870 | 6/1978 | Mathe | 439/466 |
| 4,130,329 | 12/1978 | Chandler et al. | 439/357 |
| 4,211,463 | 7/1980 | Chandler | 439/468 |
| 4,448,471 | 5/1984 | Berry et al. | 439/468 |
| 4,629,273 | 12/1986 | Van Camp | 439/272 |

FOREIGN PATENT DOCUMENTS

| | | | |
|---|---|---|---|
| 0033286 | 8/1981 | European Pat. Off. . | |
| 3437988 | 4/1986 | Fed. Rep. of Germany | 439/465 |

*Primary Examiner*—Gary F. Paumen

[57] ABSTRACT

A power connector for connecting a multiconductor cable and a printed circuit board. The power connector includes a connector block with two pivotable longitudinal walls, each having a comblike edge which, when pivoted upwards, meet to define a plurality of slots which receive and maintain the conductor of the cable. The connector block is received within a connector cover, and the assembly is mounted on a pin holder disposed on a base plate. The contact pins of the pin holder project upwards to contact the conductors of the cable and downward to contact the printed circuit board.

5 Claims, 3 Drawing Sheets

21
33
21a
34
20
22
35
22
31
35

POWER CONNECTOR

BACKGROUND OF THE INVENTION

This invention relates to power connectors and, more particularly, to power connectors for connecting an electrical cable having a plurality of conductors to, for example, a printed circuit board.

Power connectors are used to connect contact pins mounted on and projecting from the printed circuit board to the separate conductors of a connecting cable. Fairly large currents of up to 15–20 amps are often necessary for the printed circuit boards. The power connector must therefor have a structurally sound design and fulfill strict insulation requirements. The design must also be such that the placing of the plug-on portion of the connector, which contains the ends of the cable conductors, on the receiving portion of the connector, which contains the contact pins of the printed board, takes place in a very reliable and precise manner.

SUMMARY OF THE INVENTION

The present invention provides a power connector which fulfills the above-mentioned requirements. The power connector of the present invention is provided with an oblong connector block having a bottom and two pivotable longitudinal sidewalls, a blocklike connector cover, a pin holder and a base plate wherein at least two parallel rows of spring contacts are fixed perpendicularly in the longitudinal direction in chambers of the connector block formed by partitions and the bare ends of the cable conductor cores are clamped in the upper ends of the spring contacts. Each longitudinal sidewall has an upper section which can be pivoted aside outwards around a longitudinal groove and which has a comblike edge which is bent inwards and has slots so that, in their final pivoted position, the longitudinal sidewalls hold the wire ends and spring contacts in position within slots formed by the comblike edges. The connector cover receives both the connector block and its cable fed to the outside. The pin holder has at least two rows of contact pins corresponding to the spring contacts and is connected to the printed board circuit. The base plate has an oblong slot with upright walls in which the pin holder is fit tightly. The connector cover and connector block received therein are secured onto the pin holder and upright walls of the base plate so that the contact pins are received in the spring contacts.

DESCRIPTION OF THE PREFERRED EMBODIMENT

Figure 1:
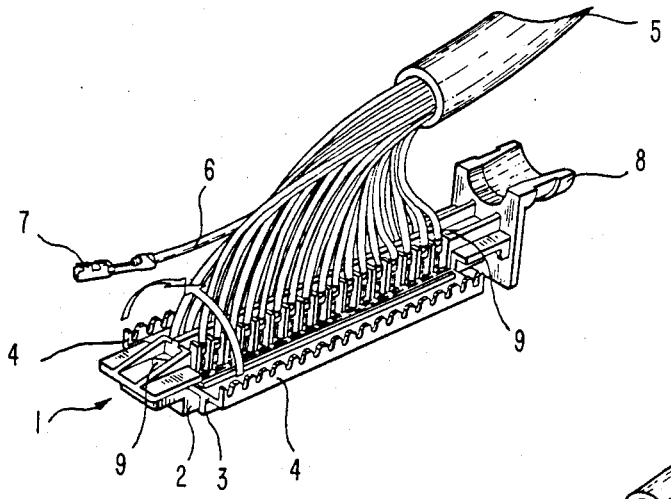
FIG. 1 shows a perspective view of the connector block according to the invention with connecting cable fitted therein.
Figure 4:
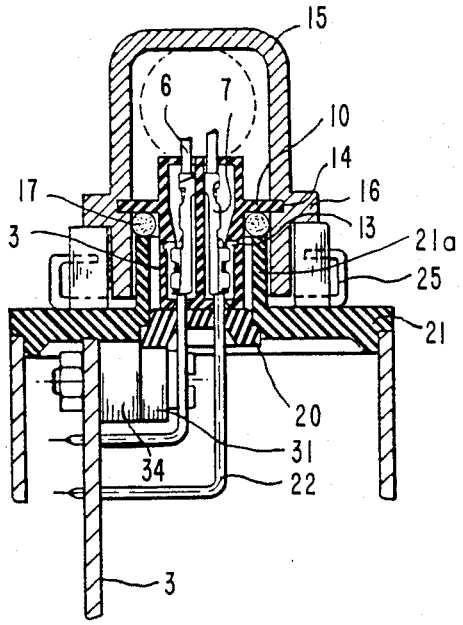
FIG. 4 shows a cross-sectional view of the connector according to the invention.

FIG. 1 shows a perspective view of the connector block 1 of the power connector according to the present invention. The connector block 1 is oblong and has a base 2 and longitudinal walls 3. As shown in FIG. 4, each longitudinal wall 3 is able to pivot outwards around a longitudinal groove 13 (shown in FIG. 4) to reach the swung-out state shown in FIG. 1. Each longitudinal wall 3 has a bent-over, comblike edge 4 with slots at its longitudinal end which, in the final closed position of the longitudinal walls, engage with the separate conductors 6 of the connecting cable 5. The bare ends of the separate conductors 6 are fixed in spring contacts 7. The spring contacts 7 are fixed upright in a clamping manner in the chambers in the connector block formed by partitions. If desired, the connector block 3 is provided at one end with a cable-receiving channel 8. At the same time, multi-sided, triangular, cut-outs 9, whose function will be explained later, are provided in the flat ends of the connector block.

Figure 2:
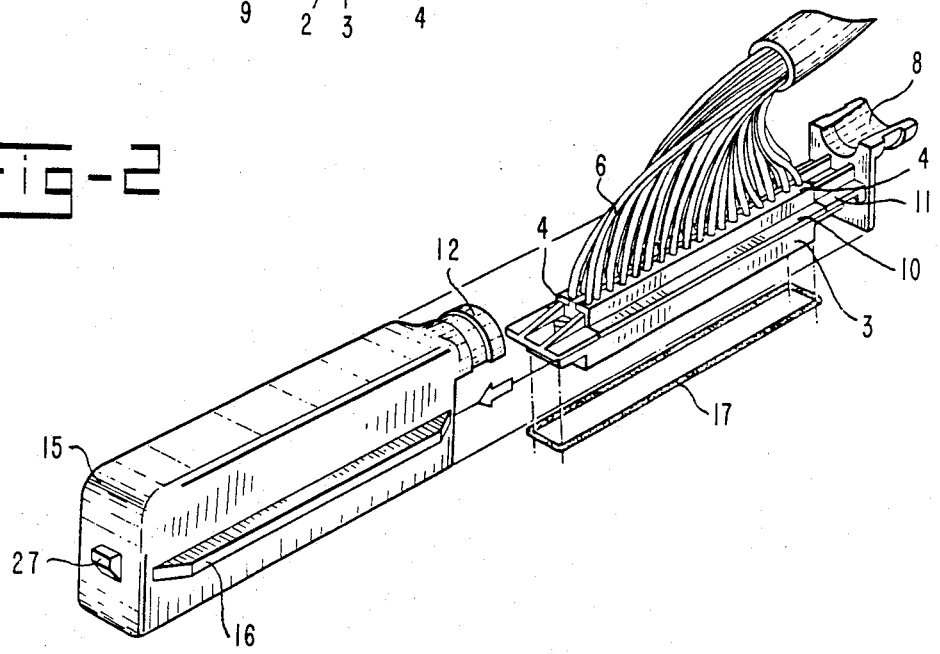
FIG. 2 shows a perspective view of the connector cover and the connector block of FIG. 1 prior to being received in the cover.

FIG. 2 shows the blocklike cover 15 into which the connector block 1 is received. The righthand portion of FIG. 2 shows the manner in which, in their final closed position, the two longitudinal walls 3 of the connector block 1 engage with the conductors 6 by means of the slots formed by the comblike edges of walls 3, and position the conductors and the spring contacts pressed thereon and keep them spaced apart. Both longitudinal walls 3 have a ledge 10 which projects outwards at right angles and which fits into a corresponding groove 14 (FIG. 4) on the inside of the two longitudinal sides of the blocklike cover 15. At the cable leadout side of the connector cover 15, the latter is provided with a cable-receiving channel 12 which fits onto the other cable-receiving channel 8 of the connector block, which to parts securely clamp the connecting cable 5.

Figure 3:
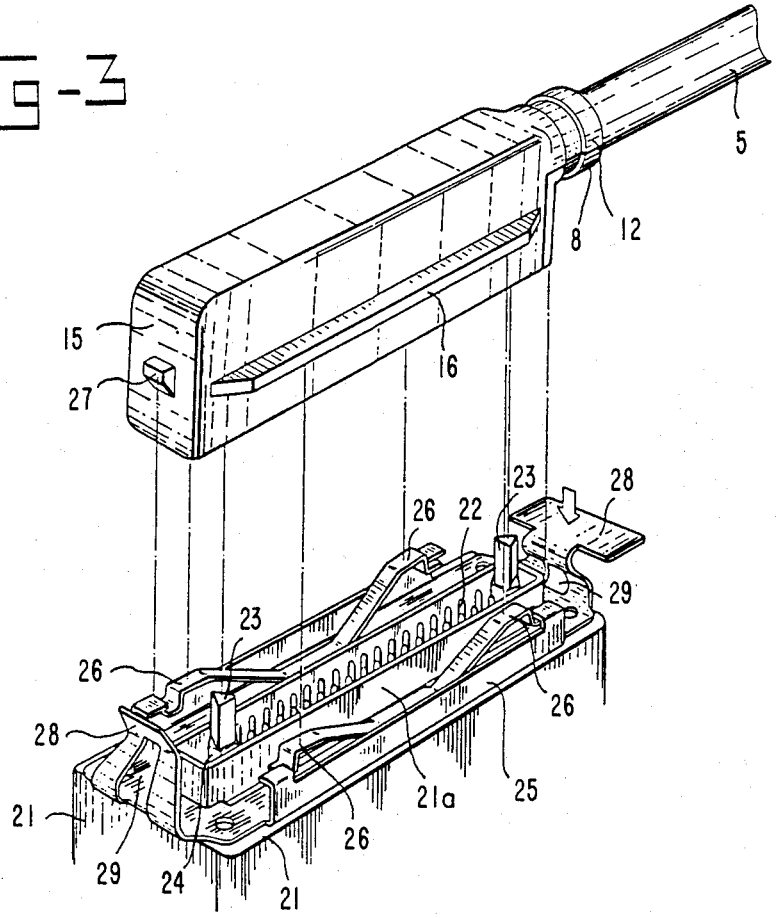
FIG. 3 shows a perspective view of the connector cover shown in FIG. 2 with connector block received therein prior to being secured onto the pin holder and base plate.

The upper portion of FIG. 3 shows the blocklike connector cover 15 with the connector block 1 received therein and the connecting cable 5 extending from this assembly. The lower portion of FIG. 3 shows the base plate 21 of the power connector.

Figure 5:
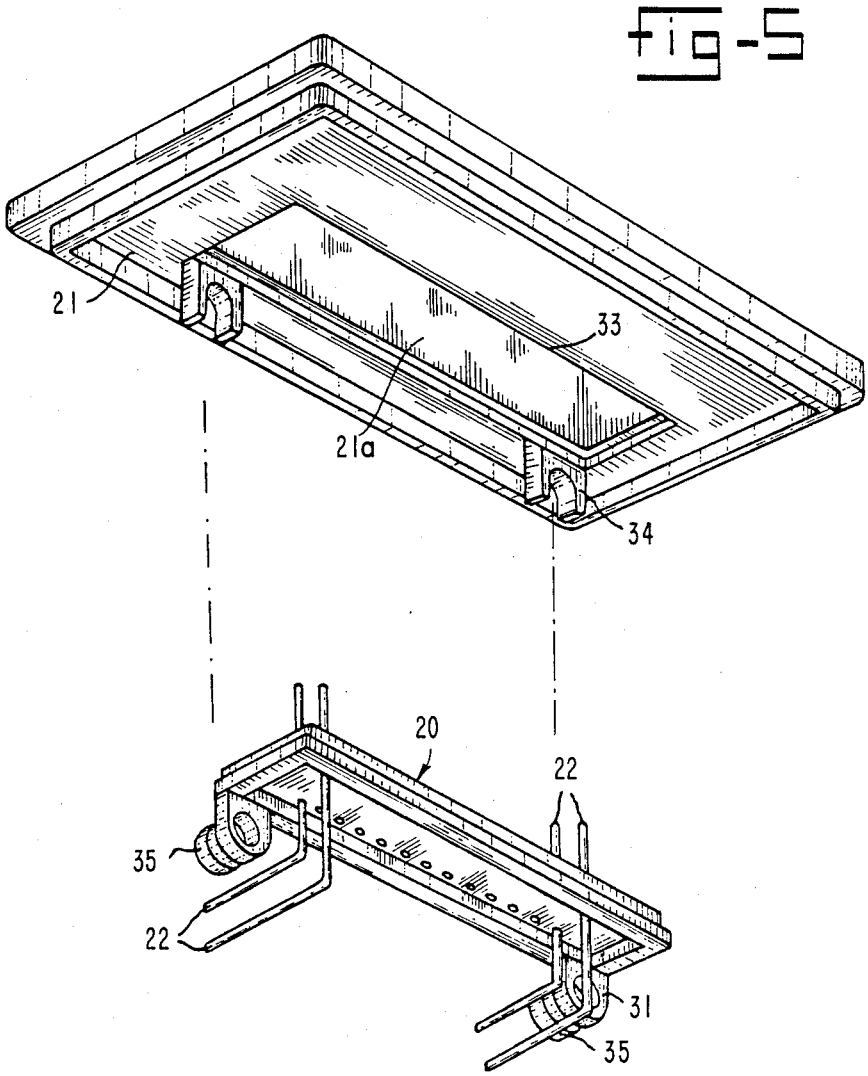
FIG. 5 shows a perspective view of the base plate and the pin holder prior to the assembly of the two.

As shown in FIG. 5, the base plate 21 has an oblong slot 33 with upright walls 21a into which the pin holder 20 is fit tightly. The bottom of the pin holder 20 contains at least two rows of contact pins 22 (shown in FIGS. 3, 4 and 5) which correspond to the spring contacts 7 and which extend perpendicularly through the bottom. When the connector cover 15 with connector block 1 is assembled on the pin holder 20, the contact pins 22 plug into the corresponding spring contacts 7 of the connector block 1 and in this manner make electrical contact with the ends of the respective conductors 6 of the connecting cable 5. At the longitudinal ends of the pin holder 20, there are provided multisided, for example triangular, coding pins 23 which are rotatably mounted on a polygonal, for example pentagonal, base 24. These coding pins 23 may be fixed in one of five positions which correspond to the triangular openings 9 (FIG. 1) at each end of the connector block 1 which are intended to receive the coding pins 23. Because there are two coding pins 23 in the pin holder 20 and, if the connector cover is correctly clamped on, these should fit into the corresponding triangular openings 9 in the connector block, there are $5 \times 5 = 25$ coding possibilities.

The lower portion of FIG. 3 shows a pretensioned spring 25 which is mounted around the upright walls 21a of the base plate 21 and which is securely fixed to the base plate 21. The pretensioned spring 25 is preferably folded from one piece of material and forms a compact whole. The spring 25 has a very important function and contributes to ensuring that if the connector cover 15 with the connector block received therein is not properly placed and locked onto the pin holder 20, the connector cover will be pushed away by the force of the spring. At the longitudinal sides of the power connector, the spring 25 has two spring parts 26 projecting upwards. The connector cover 15 also has a longitudinal edge 16 on each longitudinal side which, when the cover is pressed on, press against the spring part 25 until projections 27 at each end of the cover 15 snap into openings 29 formed in spring parts 28 which project upwards at the ends of the spring 25.

FIG. 4 shows a cross-sectional view of the power connector. The longitudinal walls 3 of the connector block 9 each have a longitudinal groove 13 around which the upper part of the longitudinal walls 3 can pivot outwards (see FIG. 1). When the swing-away portions are returned to the final closed position, the comblike edges 4 of walls 3 meet and the slots formed therebetween engage with the separate conductors of the connecting cable 5 and position them and their associated spring contacts. The longitudinal ledge 10 projecting at right angles engages in a groove 14 on the inside of the connector cover 15. Furthermore, it can be seen that when the connector cover 15 with the connector block 1 received therein is pressed onto the pin holder 20, the ledges 10 press onto the upright longitudinal walls of the base plate 20 via an O-ring 17.

The pin holder 21 is furthermore received in a slot 33 (FIG. 5) in the base plate 21 in a tight fitting and moistureproof manner with respect to the outside environment. The base plate 21 in turn forms a portion of an electronic box in which the printed circuit board 30 is mounted. The contact pins 22 of the pin holder 20 are soldered to the connecting points of the relevant circuit of the printed circuit board 30.

FIG. 5 shows the manner in which a projecting hook 31 of the pin holder 20 can interact with a separate small spacing tube 35 during the soldering process. The pin holder/contact pins combination in provisionally mounted on the printed board 30 (not shown in FIG. 5) by means of the pin holder hook 31 and the small spacing tube 35 only during the soldering process. After the soldering process, the pin holder/contact pin/printed board assembly is fixed in the slot 33 of the base plate 21, the small spacing tube being replaced by a hook 34 of the same size on the base plate, and pin holder hook 31 and base plate hook 34 are then fixed to each other with a bolt.

It should be understood that foregoing is but a preferred embodiment of the present invention and that various changes may be made without departing from the spirit and scope of the invention.

I claim:

1. A power connector for interconnecting a cable having a plurality of conductors with a printed circuit board, said power connector comprising:

a connector block having a base and two integral pivotable longitudinal walls, each longitudinal wall having a comblike edge defining slots and being pivotable upwards until said slots receive and maintain in spaced apart relationship the conductors of said cable;

a connector cover which receives said connector block with the cable conductors engaged therein, said cover having longitudinal edges projecting outwardly from longitudinal sides of the cover; and a pin holder having a plurality of electrical contact pins, said connector cover being mounted over said pin holder so that each pin electrically contacts a respective one of said cable conductors; and a base plate upon which said pin holder is disposed and a spring secured to said base plate and surrounding said pin holder, said spring having two longitudinal spring parts which are adapted to press against the corresponding longitudinal edges projecting from the longitudinal sides of the cover, and two end spring parts which are adapted to engage projections at each end of the cover and thereby ensure that the cover is latched and properly mounted on said base plate around said pin holder.

2. A power connector according to claim 1, wherein each of said pivotable longitudinal walls has a longitudinal ledge projecting outwardly at a right angle, each said ledge being received in a corresponding longitudinal groove formed on inner surfaces of said cover, thereby enabling said cover to be slid over and secured to said connector block.

3. A power connector according to claim 1, further comprising a pair of coding pins, one each projecting upwards at each end of said pin holder, each said coding pin having at least three sides and being adapted to rotate about its longitudinal axis on a multi-sided base, said connector block also having holes formed at each end which are adapted to receive said coding pins.

4. A power connector according to claim 1, wherein said printed circuit board is disposed below said base plate and is electrically contacted by said contact pins of the pin holder projecting downward from said base plate.

5. A power connector according to claim 1, further comprising a plurality of spring contacts, one each secured to the ends of each cable conductor, each said spring contact received within a slot along the comblike edges of said longitudinal walls, each said contact pin electrical contacting to a respective one of said spring contacts.

* * * * *